US005718052A

United States Patent [19]

Taomo et al.

[11] Patent Number: 5,718,052

[45] Date of Patent: Feb. 17, 1998

[54] HAND LEVER DEVICE

[75] Inventors: Toshio Taomo, Tokyo; Hisato Ohsawa, Hamura; Hirofumi Yamami, Akishima; Fumihiko Aiyama, Musashimurayama, all of Japan

[73] Assignee: Kioritz Corporation, Tokyo, Japan

[21] Appl. No.: 640,625

[22] Filed: May 1, 1996

[30] Foreign Application Priority Data

May 2, 1995 [JP] Japan ..... 7-108341

[51] Int. Cl.[6] ..... B26B 25/00

[52] U.S. Cl. ..... 30/276; 30/382; 123/198 D; 123/398

[58] Field of Search ..... 30/276, 382; 74/501.6, 74/526; 123/198 D, 398

[56] References Cited

U.S. PATENT DOCUMENTS

| | | | |
|---|---|---|---|
| 4,028,804 | 6/1977 | Hammond | 30/382 |
| 4,302,880 | 12/1981 | Elfving et al. | 30/382 |
| 4,406,066 | 9/1983 | Itzrodt | 30/382 |
| 4,570,593 | 2/1986 | Take et al. . | |
| 5,145,044 | 9/1992 | Kramer et al. | 123/198 D |
| 5,517,967 | 5/1996 | Nakayama | 123/398 |

FOREIGN PATENT DOCUMENTS 57-47405 10/1982 Japan .

*Primary Examiner*—Hwei-Siu Payer

*Attorney, Agent, or Firm*—Cushman Darby & Cushman, IP Group of Pillsbury Madison & Sutro LLP

[57] ABSTRACT

A hand lever device is disclosed which is adapted so that a throttle valve as a driven member can be adjusted appropriately in its degree of opening via a cable and kept at a desired degree of opening and yet immediately returned to the minimum degree of opening to ensure high safety. Thus, fatigue of an operator's fingers can be diminished. Also, the throttle valve is enabled to be brought to the degree of opening at which it had stood before it was returned to the minimum degree of opening without the necessity of readjustment. The hand lever device comprises an eccentric cam shaft (40) including a supporting shaft portion (42) and a pivot pin portion (41, 43) having pivotal axis (0*b*) eccentric to axis (0*a*) of the supporting shaft portion (42), a main lever (30) pivotally fitted on the supporting shaft portion (42), and a sub-lever (50) fixed to the pivot pin portion (41). The main lever (30) and sub-lever (50) are pivotally operated to draw a cable (20) connected to a driven member (CV).

5 Claims, 5 Drawing Sheets

HAND LEVER DEVICE

BACKGROUND OF THE INVENTION

1. Field of the Invention

The present invention relates to a hand lever device for operating a driven member, such as a throttle valve, of an internal combustion engine via a cable. In particular, it relates to one which is preferably mounted on a working machine such as a hedge trimmer or brush cutter in the vicinity of a grip of a handle thereof to operate a throttle valve or the like via a throttle cable or the like.

2. Description of the Prior Art

For example, in a working machine such as a hedge trimmer and brush cutter, an operative portion including a cutting blade and the like is driven generally by an internal combustion engine. A lever device for controlling the degree of opening of a throttle valve of the internal combustion engine is mounted in the vicinity of a grip of a U-shaped handle, bar handle or the like of the working machine so as to control the output force of the internal combustion engine by hand.

The lever device is generally provided with a throttle trigger (throttle lever) operated by operator's fingers and adapted so that the throttle lever is pivotally operated to thereby control the degree to which the throttle valve is opened via a throttle cable. In general, the throttle valve is always biased toward the direction of a minimum degree of opening (for idle rotation). Accordingly, it is normally kept at the minimum degree of opening for idle rotation, and when the throttle cable is drawn to a predetermined amount to eliminate play, it begins to open from the minimum degree of opening for idle rotation to an degree of opening for high speed rotation.

Known lever devices for controlling the degree of opening of a throttle valve include an auto-return type which is adapted so that when a throttle lever is released from a pivotally operated position, the lever is automatically caused to return to original position (degree of opening for idle rotation) together with a throttle valve, and an immobilizable type adapted so that if fingers are released from a throttle lever, the throttle lever can always be immobilized at a desired pivotally operated position (see Japanese Examined Utility Model Publication No.19944/1982, etc.)

In the auto-return type type discussed above, when fingers are released from a throttle lever, an engine is automatically caused to return to idle. Consequently, if the auto-return type is used in a working machine and adapted so that output force of the engine is transmitted to an operative portion including a cutting blade via a centrifugal clutch, the centrifugal clutch is disconnected to cut off the transmission of the driving force to the operative portion. Accordingly, the operation of the operative portion can immediately be stopped by returning the throttle valve to the degree of opening for idle rotation when accident is caused, thereby advantageously attaining improved safety. On the other hand, the throttle valve must be held continuously by fingers at a desired pivoted operating position. This causes problems in that this type of lower device is awkward for intermediate degrees of opening, the operator's fingers are susceptible to fatigue, and the operated amount (rotational speed) is likely to be unstable.

In contrast thereto, the immobilizable type is capable of solving the above problems in the auto-return. That is, it is capable of providing advantages because a throttle lever can always be immobilized at a desired pivotal operation position without the operator holding it with his/her fingers. Moreover, that operation is performed with ease because the operator's fingers are liberated from holding it. However, since additional operation is required to liberate the throttle lever from the immoblized position, it is impossible to immediately stop an operative portion even if accident is caused. Accordingly, there is a problem that, in terms of safety, the immobilizable type is inferior to the auto-return type.

Further, in either type, once the throttle lever has been released to suspend operation, if the lever is to be returned to the previous degree of opening to resume the operation (which situation a working machine such as a brush cutter is often), the pivotally operated position of the throttle lever must be readjusted. Thus, there is still room for improvement in operability in view of such cumbersome operation.

SUMMARY OF THE INVENTION

The present invention has been made in view of these problems. It is, therefore, an object of the present invention to provide a hand lever device which is adapted so that a throttle valve as a driven member can be adjusted appropriately in its degree of opening via a cable and kept at a desired degree of opening and yet immediately returned to the minimum degree of opening to ensure high safety. It is another object of this invention that fatigue of the operator's fingers can be diminished, and that the throttle valve is advantageously enabled to be brought to the degree of opening at which it had stood before it was returned to the minimum degree of opening without the necessity of readjustment.

To attain the above-mentioned objects, the hand lever device according to the present invention, as a basic embodiment, comprises: an eccentric cam shaft including a supporting shaft portion and a pivot pin portion having pivotal axis eccentric to axis of the supporting shaft portion, a main lever pivotally fitted on the supporting shaft portion, and a sub-lever fixed to the pivot pin portion; the main lever and sub-lever being pivotally operated to draw a cable connected to a driven member.

As a preferred embodiment of the present invention, the driven member is a throttle valve of an internal combustion engine.

Further, it is preferred in the present invention that the sub-lever be adapted to be immobilized at a desired position.

In the case where the driven member is a throttle valve of an internal combustion engine, a more preferred embodiment is a specific form having the following construction.

A hand lever device disposed in the vicinity of a grip of a handle of a working machine comprising an operative portion including a cutting blade driven by an internal combustion engine provided with a throttle valve, said throttle valve being always biased in the direction of the degree of opening for idle rotation and thereby adapted so that when a throttle cable connected thereto is drawn from non-operating position by a predetermined amount or more, the play is eliminated and the throttle valve begins to open from the degree of opening for idle rotation; the hand lever device comprising: an eccentric cam shaft including a supporting shaft portion and a pivot pin portion having pivotal axis eccentric to axis of the supporting shaft portion, a main lever pivotally fitted on the supporting shaft portion, the main lever being pivotally operated to draw the cable, thereby eliminating the play, and a sub-lever fixed to the pivot pin portion, the sub-lever being pivotally operated to control the degree of opening of the throttle valve.

In the preferred form of the hand lever device according to the present invention which is constructed as described above, when the main lever is operated by fingers of the hand which is gripping the grip of the handle to pivot about the axis of the supporting shaft portion to the set position close to the grip, the throttle cable is drawn by the main lever by a predetermined amount to eliminate the play. While holding the main lever at the set position, the sub-lever is then operated to pivotally move to a desired position. In association with the sub-lever, the supporting shaft of the eccentric cam shaft thereby acts as a cam to move, being accompanied by the main lever, forward about the axis of the pivot pin portion.

The throttle cable is thereby further drawn via the main lever to rotate the throttle valve from the minimum degree of opening (for idle rotation) in the opening direction, thus adjusting the degree of opening of the throttle valve.

In this condition, even if operator's hold on the sub-lever is released, the sub-lever is kept immobilized still at the operational position by the frictional force with, for example, the cover case of the hand lever device. Accordingly, the throttle valve is kept at the adjusted degree of opening (set opening degree), thereby relieving the fatigue of fingers.

In the event that it is necessary due to occurrence of accident or the like to immediately lower the rotational speed of the engine, the main lever is released. Because the throttle is cable of being biased toward the throttle valve narrowing direction, the main lever is drawn by the throttle cable to return to the original position, and the throttle cable is returned to the non-operating position to return the throttle valve to the degree of opening for idle rotation. Consequently, the engine is brought to idling. Accordingly, if a working machine is adapted so that rotational driving force of an engine is transmitted to an operative portion including a cutting blade and the like via a centrifugal clutch, the centrifugal clutch is disconnected to cut off the transmission of the driving force to the operative portion, thereby enabling the operative portion including the cutting blade to be immediately stopped.

When the main lever is again pivotally moved to the set position close to the grip after having been once released, the play of the throttle cable is eliminated with the sub-lever still immobilized at the operational position previously set. Consequently, the throttle valve is returned to the degree of opening at which it had stood before the main lever was released, without necessity of readjusting the sub-lever.

DESCRIPTION OF THE PREFERRED EMBODIMENTS

Now, the present invention will be described in more detail with reference to the accompanying drawings.

Figure 1:
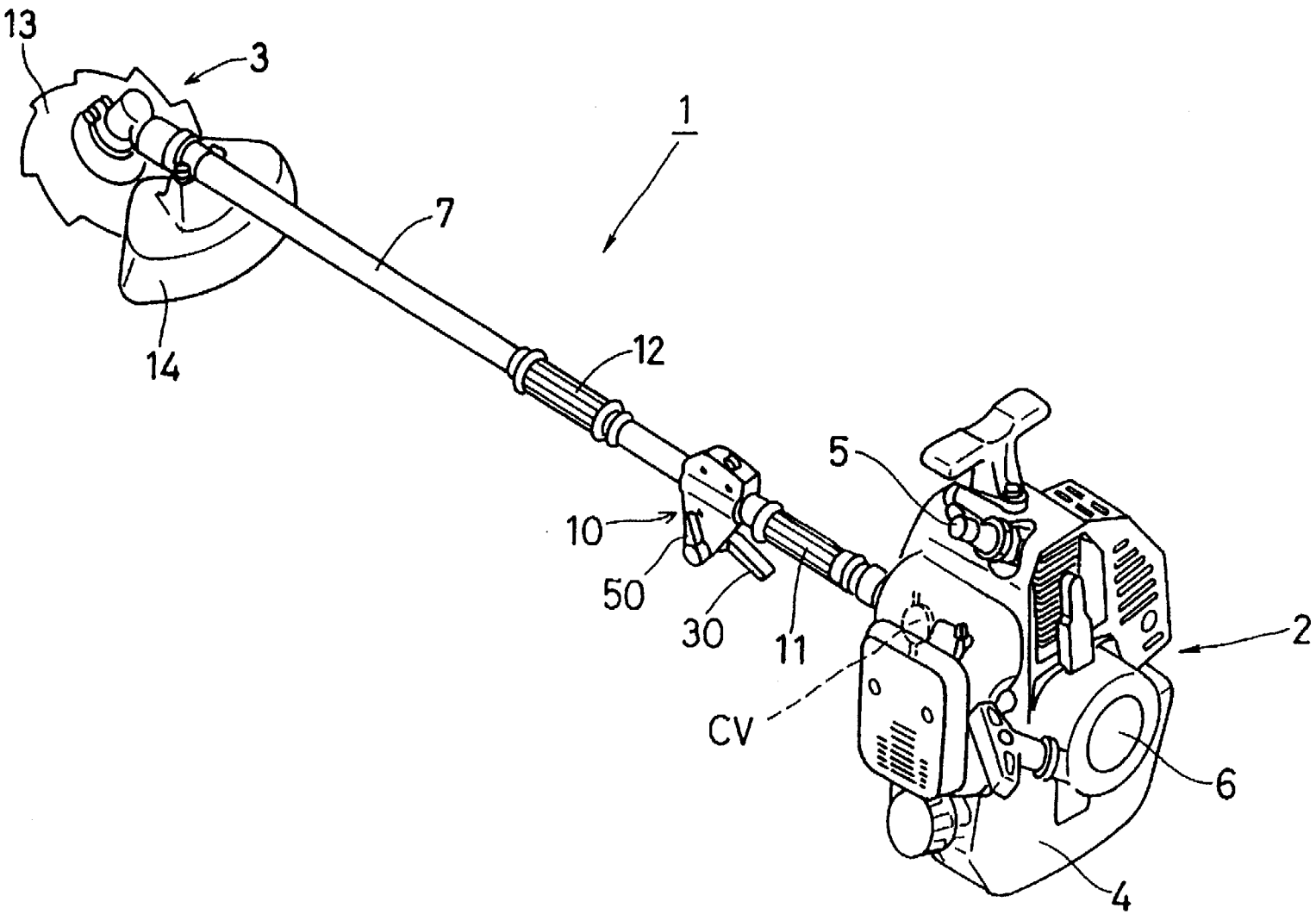
FIG. 1 is a perspective view showing an example of a brush cutter adopting an embodiment of the hand lever device according to the present invention.

FIG. 1 shows an example of a brush cutter employing one embodiment of the hand lever device 10 according to the present invention. The illustrated brush cutter 1 comprises a bar handle (operating rod) 7 provided with grips 11, 12 spaced a predetermined distance apart. An operative portion 3 is provided on the distal end of the bar handle 7 and includes a cutting blade 13, a safety cover 14 and the like. An internal combustion engine (for example, a small air-cooled two-cycle gasoline engine) 2 is disposed on the proximal end of the bar handle 7 and serves as a driving power source for driving the cutting blade 13 via a drive shaft 8 inserted through the bar handle 7. The internal combustion engine 2 is provided with a carburetor having a throttle valve CV and a spark plug 5. The internal combustion engine 2 also is provided with a fuel tank 4 and a recoil starter 6.

Figure 2:
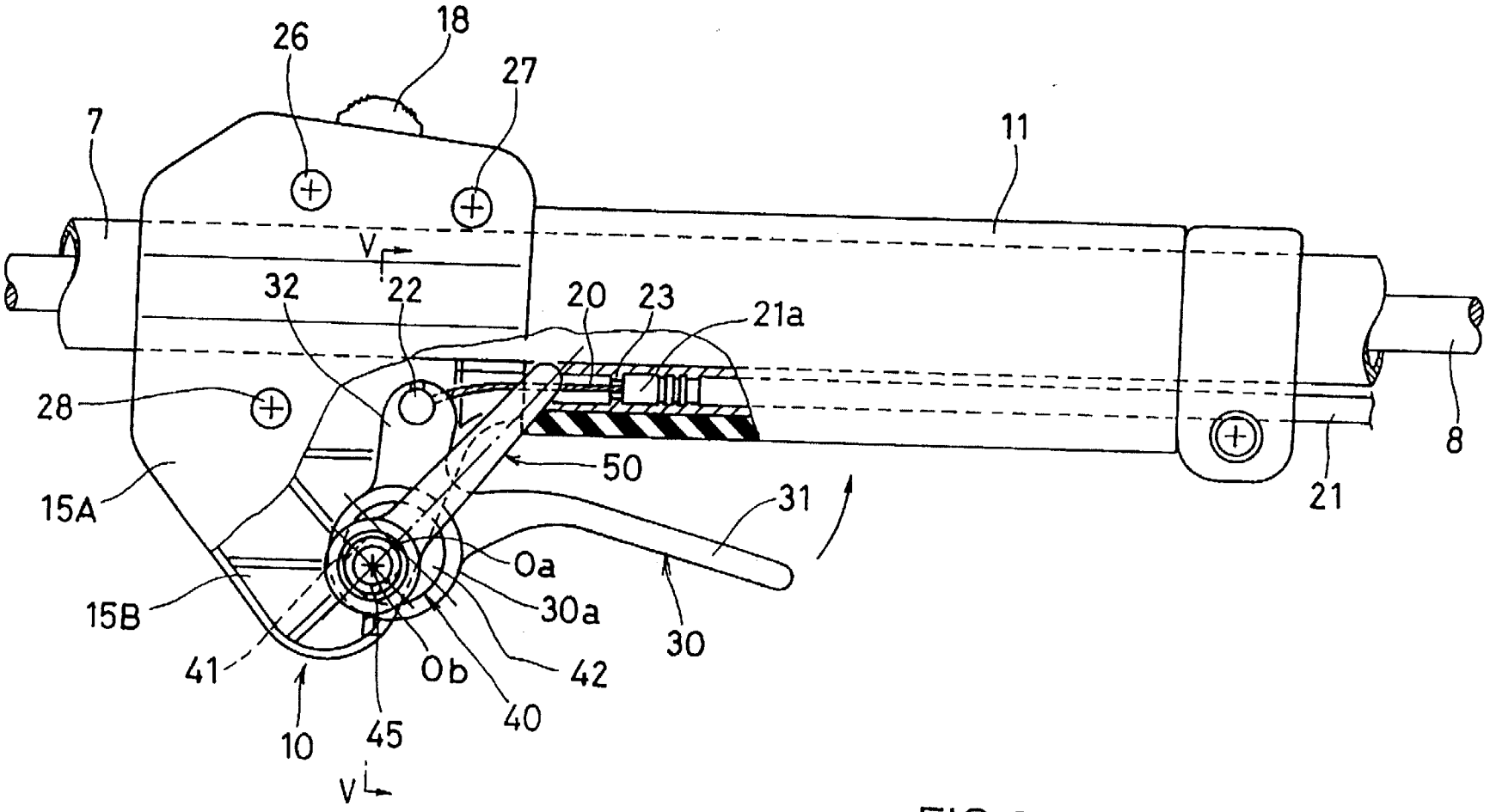
FIG. 2 is a left side view showing the one embodiment of the hand lever device according to the present invention, in which the hand lever device is shown as being partially cut away to show its main portion.

In this example, the throttle valve CV is always biased in the direction of minimum degree of opening (for idle rotation) and thereby adapted so that when a throttle cable 20 (see FIG. 2) connected thereto (described below) is drawn from a non-operating position by a predetermined amount or more, the play is eliminated and consequently the throttle valve CV begins to open from the minimum degree of opening.

In the vicinity of the front end of the grip 11, which is the one grip of the grips 11 and 12 that is gripped generally by operator's right hand, the one embodiment of the hand lever device 10 is provided to adjust the degree of opening of the throttle valve CV.

As shown in FIGS. 2 to 5, the hand lever device 10 comprises an L-shaped main lever 30 having a grip portion 31 and a locking portion 32 provided on a base end 30*a* of the grip portion 31, a sub-lever 50, an eccentric cam shaft 40, and a hollow cover case composed of right and left cover case members 15A, 15B (hereinafter often referred to simply as cover case 15A, 15B) for pivotally holding them. The cover case 15A, 15B has its upper portion inserted through the bar handle 7 and fixedly mounted on the bar handle 7 in the vicinity of the grip 11 by means of bolt assortments (each of which means a combination of a bolt or screw, a nut, a washer and the like, and the same applies hereinbelow) such as 26, 27 and 28. The hand lever device 10 also includes an engine stop switch 18.

A throttle cable 20 leads into the cover case 15A and 15B and which is connected to the throttle valve CV of the internal combustion engine 2 at the other end and inserted through an outer tube 21 of a Bowden cable. The distal end 21*a* of the outer tube 21 is fastened by a fastening means 23 provided at a lower position inside the grip 11. The one end of the throttle cable 20 is locked with its terminal metal piece 22 fitted into a locking portion 32 of the main lever 30.

Figure 3:
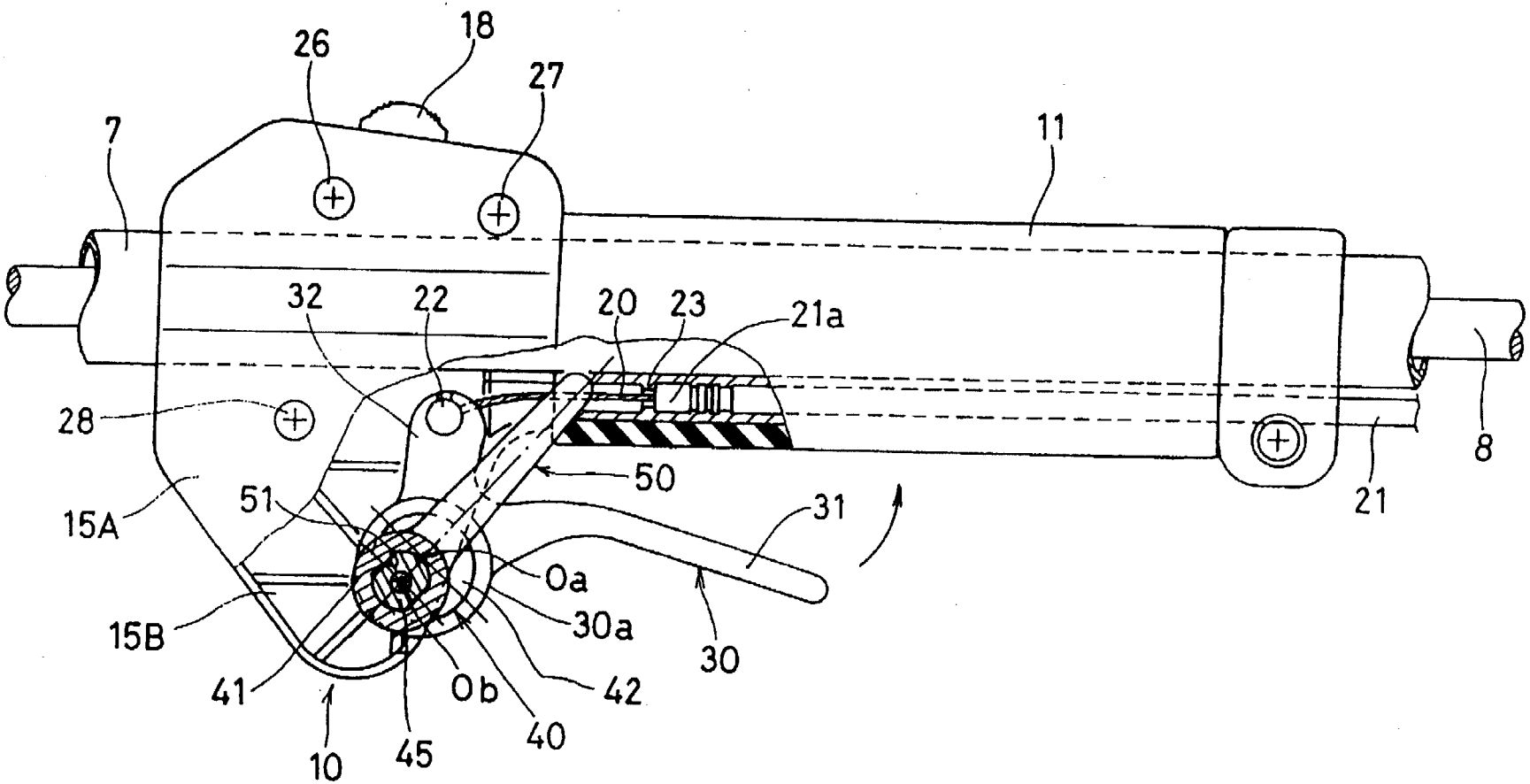
FIG. 3 is an partially cutaway side view for illustrating the main portion of the hand lever device shown in FIG. 2.
Figure 5:
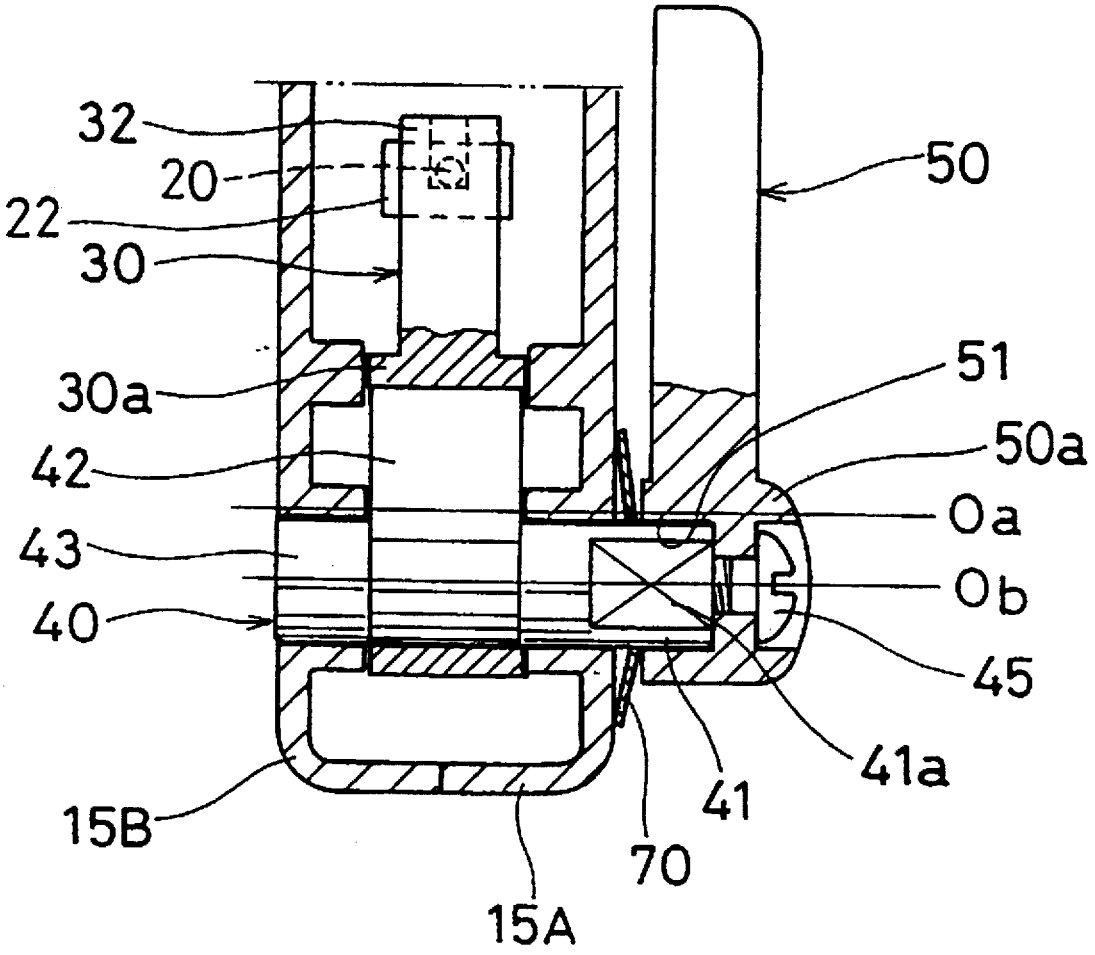
FIG. 5 is an enlarged sectional view taken along the line V—V and viewed in the direction of the arrows in FIG. 2.

As will be seen with reference to FIGS. 3 and 5, the eccentric cam shaft 40 includes a supporting shaft portion 42 which acts as a cam, and pivot pin portions 41, 43 having pivotal axis 0*b* which is downwardly eccentric to axis 0*a* of the supporting shaft portion 42. The right and left pivot pin portions 41, 43 are rotatably supported by the cover case members 15A, 15B, respectively, and the main lever 30 is pivotally fitted on the supporting shaft portion 42 (at its base end 30*a*). The right pivot pin portion 41 has its sides in part cut off in a parallel fashion to provide a rotation-preventive fixing portion 41*a*, over which a recess 51 formed in a base end 50*a* of the sub-lever 50 is fitted, and the sub-lever 50 is fixed to the right pivot pin portion 41 by means of a bolt assortment 45 screwed into the right pivot pin portion 41 along the direction of the lower pivotal axis 0*b*.

Between the sub-lever 50 and the right cover case member 15A, a belleville spring 70 is interposed. By adjusting the amount the bolt assortment 45 is screwed under the elastic action of the belleville spring 70, frictional force between the sub-lever 50 and the side of the right cover case member 15 A is controlled. The sub-lever 50 is thereby immobilized at its pivotally operated position.

Figure 4:
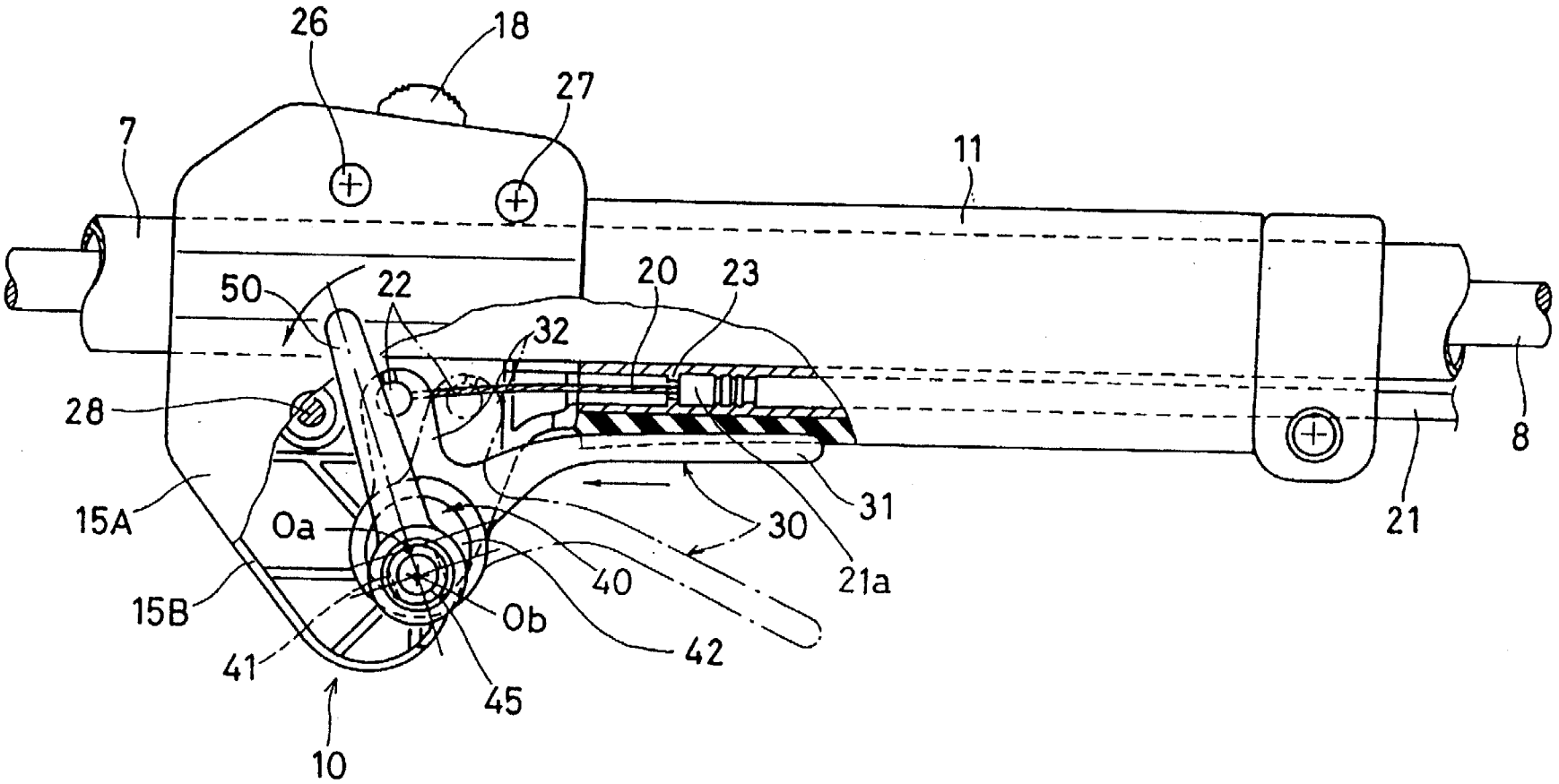
FIG. 4 is an illustrative view for illustrating operation of the hand lever device shown in FIG. 2.

In the hand lever device 10 of this embodiment which is constructed as described above, when the main lever 30 is moved to pivot about the axis 0*a* of the supporting shaft portion 42 to a set position close to the grip 11, the throttle cable 20 is drawn by the main lever 30 by a predetermined amount to eliminate its play. While holding the main lever 30 at the set position, the sub-lever 50 is then operated by fingers of the hand to pivotally move to a position corresponding to a desired rotational speed of the internal combustion engine 2. In association with the sub-lever 50, the supporting shaft 42 of the eccentric cam shaft 40 thereby acts as a cam to move, being accompanied by the main lever 30, forward about the axis 0*b* of the pivot pin portions 41, 43, as shown in FIG. 4.

The throttle cable 20 is thereby further drawn via the locking portion 32 of the main lever 30 to rotate the throttle valve CV from the minimum degree of opening (for idle rotation) in the opening direction, thus adjusting the degree of opening of the throttle valve CV. In this operation, the main lever 30 as a whole is caused to move toward the left of FIG. 4. However, fingers are subjected to no substantial fatigue and hence the operation is performed with ease.

In this condition, even if the fingers are removed from the sub-lever 50, the sub-lever 50 is kept immobilized still at the pivotally operated position by the frictional force between the eccentric cam shaft 40 and the cover case member 15A. Accordingly, the throttle valve CV is kept at the adjusted opening degree (set opening degree), thereby enabling fatigue of the fingers to be relieved.

In the event that it is necessary to immediately lower the rotational speed of the engine 2 due to occurrence of an accident or the like, the main lever 30 at this position is released. The main lever 30 is thereby drawn by the throttle cable 20 to return to the original position, and the throttle cable 20 is returned to the non-operating position to return the throttle valve CV to the minimum degree of opening. Consequently, the engine 2 is brought into idle rotation. In this example, rotational driving force of the engine 2 is transmitted to the operative portion 3 including the cutting blade 13 and the like via a centrifugal clutch (not shown). Accordingly, the centrifugal clutch is automatically disconnected to cut off the transmission of the driving force to the operative portion 3, thereby immediately stopping the operation of the operative portion 3 including the cutting blade 13.

When the main lever 30 is again operated to pivotally move to the set position close to the grip 11 after having been released, the play of the throttle cable 20 is eliminated with the sub-lever 50 still immobilized at the pivotal operation position previously set. Consequently, the throttle valve CV is returned to the degree of opening at which it had stood before the main lever 30 was released, without the necessity of readjusting the sub-lever 50.

In the above example, the hand lever device 10 according to the present invention is used to control degree of opening of the throttle valve CV of the internal combustion engine 2. It is, however, to be noted that the hand lever device according to the present invention may of course be used in applications other than adjusting the degree of opening of a throttle valve, such as a safety brake device.

Further, besides the bar handle 7, the hand lever device 10 may be used by mounting it on a U-shaped handle and the like.

As understood from the above description, according to the hand lever device of the present invention, excellent benefits are attained. For example, the throttle valve as a driven member can be adjusted appropriately in its opening degree of opening via the cable and kept at a desired degree of opening and yet immediately returned to the minimum degree of opening to ensure high safety, fatigue of the operator's fingers is diminished, and the throttle valve is advantageously enabled to be brought to the degree of opening at which it had stood before it was returned to the minimum degree of opening without the necessity of readjustment.

What is claimed is:

1. An apparatus comprising:

a working machine comprising:

a handle having a grip, an operative portion including a cutting blade, an internal combustion engine driving said cutting blade and provided with a throttle valve, said throttle valve being always biased in the direction of a degree of opening for idle rotation and thereby adapted so that when a throttle cable connected thereto is drawn from a non-operating position by a predetermined amount or more, play is eliminated and the throttle valve begins to open from the degree of opening for idle rotation;

a hand lever device disposed in the vicinity of said grip of said handle comprising:

an eccentric cam shaft including a supporting shaft portion and a pivot pin portion having a pivotal axis eccentric to an axis of the supporting shaft portion, a main lever pivotally fitted on the supporting shaft portion, said main lever being pivotally operated to draw the cable, thereby eliminating the play, and a sub-lever fixed to the pivot pin portion, said sub-lever being pivotally operated to control the degree of opening of the throttle valve.

2. The apparatus according to claim 1, wherein the sub-lever is adapted to be held immobilized at a desired position.

3. A hand lever device comprising:

an eccentric cam shaft including a supporting shaft portion and a pivot pin portion having a pivotal axis eccentric to an axis (0*a*) of the supporting shaft portion, a main lever pivotally fitted on the supporting shaft portion, a sub-lever fixed to the pivot pin portion; and said main lever and sub-lever being pivotally operated to draw a cable connected to a driven member.

4. The hand lever device according to claim 3, wherein the driven member is a throttle valve of an internal combustion engine.

5. The hand lever device according to claim 3, wherein the sub-lever is adapted to be held immobilized at a desired position.

* * * * *